US006257249B1

(12) United States Patent
Thomas et al.

(10) Patent No.: US 6,257,249 B1
(45) Date of Patent: Jul. 10, 2001

(54) HAIR CLAMP

(76) Inventors: Samuel L. Thomas; Elizabeth G. Owen-Thomas, both of 1400 Plumcrest Dr., Charlotte, NC (US) 28216

( * ) Notice: Subject to any disclaimer, the term of this patent is extended or adjusted under 35 U.S.C. 154(b) by 0 days.

(21) Appl. No.: 09/364,215

(22) Filed: Jul. 29, 1999

Related U.S. Application Data

(60) Provisional application No. 60/094,959, filed on Jul. 31, 1998.

(51) Int. Cl.[7] ..... A45D 8/04; A45D 8/00; A45D 8/20

(52) U.S. Cl. ..... 132/273; 132/276; 132/277

(58) Field of Search ..... 132/273, 275, 132/276, 277, 278, 279; 24/331, 337

(56) References Cited

U.S. PATENT DOCUMENTS

| | | | | |
|---|---|---|---|---|
| 1,474,474 | | 11/1923 | Hoffman . | |
| 1,958,160 | | 5/1934 | Cherico et al. . | |
| 2,171,019 | * | 8/1939 | Zupnyk | 132/273 |
| 2,902,042 | * | 9/1959 | Halber | 132/279 |
| 3,590,830 | * | 7/1971 | Hannum | 132/273 |
| 5,181,530 | * | 1/1993 | Chou | 132/278 |
| 5,365,955 | | 11/1994 | Desgroux et al. . | |
| 5,458,109 | | 10/1995 | Tu . | |
| 5,477,870 | | 12/1995 | Menaged . | |
| 5,495,862 | | 3/1996 | Dewing . | |
| 5,709,231 | * | 1/1998 | Yasuda | 132/278 |
| 5,816,267 | * | 10/1998 | Chou | 132/278 |
| 5,862,814 | * | 1/1999 | Janik et al. | 132/278 |

* cited by examiner

*Primary Examiner*—John J. Wilson
*Assistant Examiner*—Robyn Kieu Doan
(74) *Attorney, Agent, or Firm*—Christopher C. Dremann

(57) ABSTRACT

The present invention is a hair clamp including an elongate, arcuate base having opposed ends and a pair of articulated arms for holding braided or otherwise gathered strands of hair. Each arm is pivotally attached to the base proximate to one of the opposed ends. The arms are independently rotatable between a hair-receiving, or open, position generally perpendicular to the base and a hair-holding, or closed, position generally parallel to the base. The hair clamp also includes biasing means for biasing the arms in the closed position, retaining means for retaining the arms in the open position and releasing means for releasing the arms to rotate under the influence of the biasing means from the open position to the closed position. The biasing means preferably is a torsion spring positioned between each of the arms and the base. The retaining means preferably includes a stop pin depending outwardly from each of the arms and a corresponding mechanical stop. The releasing means preferably includes a control lever movable relative to the articulated arms and the base. In a preferred embodiment, depressing a release button provided on the control lever causes the mechanical stops to release the stop pins, thereby permitting the torsion springs to rotate the arms to the closed position around the gathered strands of hair.

13 Claims, 5 Drawing Sheets

HAIR CLAMP

CROSS REFERENCE TO RELATED APPLICATION

This application claims the benefit of the filing date of U.S. Provisional Patent Application Ser. No. 60/094,959 filed Jul. 31, 1998, the entire disclosure of which is expressly incorporated herein.

FIELD OF THE INVENTION

The present invention relates generally to an apparatus for holding strands of hair. More particularly, the invention is a hair clamp having a base and a pair of articulated arms for holding braided or otherwise gathered strands of hair.

BACKGROUND OF THE INVENTION

Hair clips and barrettes are frequently used, primarily by girls and women, to hold braided or otherwise gathered strands of hair in an aesthetically pleasing manner. Hair clips and barrettes are also used to help control hair that is difficult to manage. Though existing hair clips and barrettes generally accomplish these intended tasks, they suffer from numerous disadvantages.

The common barrette includes a decorative or ornamental outer member that is pivotally coupled to an inner locking clip. In operation, the outer member is passed over gathered strands of hair and the inner locking clip is simultaneously passed under the strands of hair. This is done from the side, generally perpendicular to the gathered strands of hair. The outer member and the inner-locking clip are then pivoted to a closed position and fastened together such that the gathered strands of hair are held between the outer member and the inner locking clip.

When attempting to hold gathered strands of hair with a barrette, it is very difficult to hold the desired amount of hair. As a result, the wearer often inadvertently holds too little or too much hair. When too much hair is held, the barrette pulls on the wearer's scalp. When too little hair is held, the barrette tends to fall out, and thereby release the hair. Furthermore, barrettes tend to apply pressure unevenly to the gathered strands of hair. The strands of hair held in a barrette are subjected to more or less pressure depending upon where a particular strand is positioned within the barrette's clip. Another problem with barrettes is that during removal, the gathered strands of hair can get caught in the hinge or the locking clip. When this occurs, the strands of hair may be pulled out of the wearer's scalp, which can be painful. Finally, the barrette's lock can be difficult to find when removal of the barrette is desired.

A typical hair clip includes a pair of jaws operable by a pair of short, opposed opening levers and a torsion spring that biases the jaws in a closed position. In operation, the levers are squeezed together, thereby causing the jaws to open. The open jaws are positioned around the gathered strands of hair and the levers are released, thereby allowing the torsion spring to return the jaws to the closed position so that the gathered strands of hair are held between the closed jaws.

The torsion springs utilized in such hair clips must create enough torque to hold the gathered strands of hair securely between the closed jaws. As a result, substantial force must be applied to the short levers to open the jaws sufficiently to position the open jaws around the gathered strands of hair. Once opened, the jaws must be held open continuously until the gathered strands of hair are properly positioned within the hair clip. Because of the short moment arm of the lever, it can be difficult for some wearer's to hold the jaws open for more than a short time. Furthermore, such hair clips have aesthetic drawbacks. The configuration of the jaws of the hair clip leaves the posterior side of the hinge area and the metal spring exposed. This is particularly unattractive as it gives a somewhat mechanical appearance to the hair clip, thereby detracting from its intended decorative or ornamental appearance.

A need, therefore, exists for an attractive hair clamp that is both decorative and easy to use and that holds braided or otherwise gathered strands of hair uniformly without causing discomfort to the wearer.

OBJECTS OF THE INVENTION

Accordingly, a principal object of the present invention is to provide a hair clamp for holding braided or otherwise gathered strands of hair that is both decorative and easy to use, and that does not cause discomfort to the wearer.

A further and more particular object of the invention is to provide a hair clamp for holding gathered strands of hair that can be inserted from above rather than from the side.

Another object of the invention is to provide a hair clamp for holding gathered strands of hair that allows a variable amount of hair to be held without pulling on the wearer's hair or scalp.

Another object of the invention is to provide a hair clamp for holding gathered strands of hair that can be easily removed without pulling on the wearer's hair or scalp.

Another object of the invention is to provide a hair clamp for holding gathered strands of hair uniformly over the entire useable length of the hair clamp.

SUMMARY OF THE INVENTION

The present invention is an apparatus for holding braided or gathered strands of hair. More particularly, the invention is a hair clamp including an elongate body having opposed ends and a pair of articulated arms rotatably attached to the body. The outer surface of the body may be decorative or ornamental for aesthetic purposes.

Each articulated arm of the hair clamp is pivotally attached to the body proximate to one of the opposed ends so that each arm can be independently rotated, as will be described, between a hair-receiving, or open, position generally perpendicular to the body and a hair-holding, or closed, position generally parallel to the body. When moving from the open position to the closed position, the arms rotate inwardly toward one another, thereby creating a hair-holding area between the arms and the inner surface of the body.

The hair clamp also includes means for biasing the arms in the closed position, means for retaining the arms in the open position against the force of the biasing means and means for releasing the arms from the open position to the closed position. A control lever allows the wearer to disengage the arms from the retaining means, thereby permitting the biasing means to rotate the arms to the closed position.

In a preferred embodiment, the body includes a generally rectangular, arcuate base having an outer surface and an inner surface. Each of a pair of opposed, arcuate sides depends generally perpendicularly from the inner surface of the base. The biasing means is a torsion spring positioned between a proximate region of each arm and the base. The retaining means includes a pair of stops pins, each extending generally perpendicularly from the proximate region of one of the arms, and a complementary pair of mechanical stops, each extending inwardly from the inner surface of one of the sides adjacent an opposed end of the base. The releasing means includes the control lever and a resilient yielding means for permitting inward movement of the center of the control lever adjacent the center of the base. Preferably, the control lever is one of the opposed sides of the hair clamp and is biased by the yielding means against a pair of spaced apart projections depending generally perpendicularly from the inner surface of the base. Preferably, the projections are located equidistant from the center of the base and outwardly of the control lever.

Depressing the control lever at a medial location between the pair of spaced apart projections causes the mechanical stops to move outwardly away from the stop pins, thereby releasing the articulated arms from the mechanical stops. As a result, the biasing force of the torsion springs rotates the arms to the closed position. A release button may be provided on the outer surface of the control lever adjacent the center of the base to indicate where to activate the releasing means.

The present invention enables gathered strands of hair to be held securely without excessive force, thereby eliminating the disadvantages associated with holding gathered strands of hair using conventional barrettes and hair clips. In accordance with the present invention, the articulated arms are not locked in the closed position. Also, the ends of the arms overlap slightly. Consequently, a variable amount of hair can be held with the arms in the closed position without any loss of the gathered strands of hair. In addition, strands of wet hair can be held securely in the hair clamp even though wet hair tends to expand as it dries. Because the articulated arms of the hair clamp are not locked in the closed position, the gathered strands of hair are subjected to uniform pressure, thereby ensuring that the strands are uniformly distributed over the entire useable length of the hair clamp. Thus, the gathered strands of hair have a uniform appearance. Furthermore, each of the arms preferably has a scalloped inner profile for preventing bunching of the gathered strands of hair.

BRIEF DESCRIPTION OF THE DRAWINGS

The foregoing and other objects will become more readily apparent by referring to the following detailed description and the appended drawings in which.

DETAILED DESCRIPTION OF THE PREFERRED EMBODIMENTS

Figure 1:
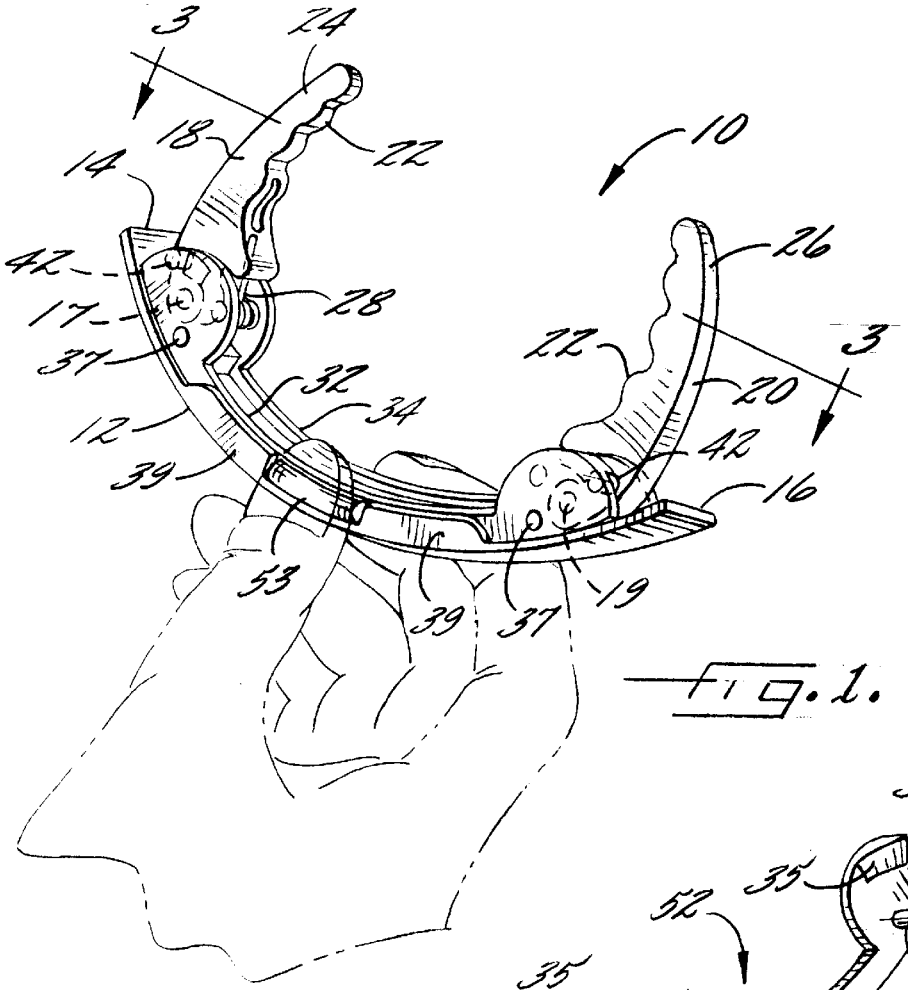
FIG. 1 is a perspective view of a hair clamp according to the invention shown with the articulated arms in the hair-receiving, or open, position.
Figure 2:
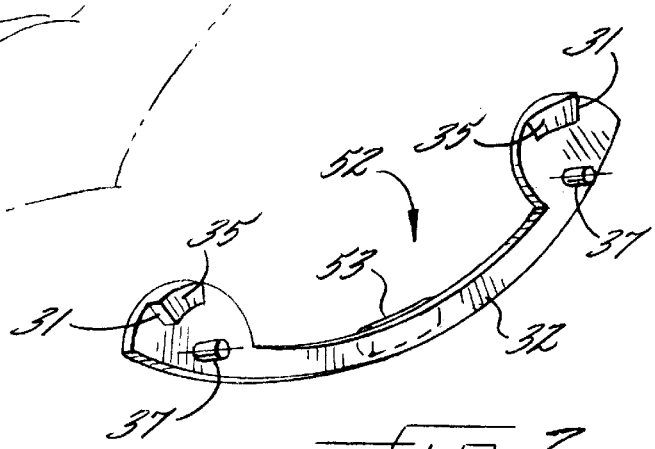
FIG. 2 is a perspective view of the control lever of a preferred embodiment of a hair clamp according to the invention.

Referring now to FIG. 1 of the drawings, the invented apparatus is a hair clamp, indicated generally at 10, for holding braided or otherwise gathered strands of hair. In the broadest sense, the hair clamp 10 comprises an elongate body 12 having opposed ends 14, 16 and a pair of articulated arms 18, 20. As is known, the outer surface of body 12 may be decorative or ornamental. Arm 18 is pivotally attached to body 12 about pivot 17 adjacent end 14. Arm 20 is pivotally attached to body 12 about pivot 19 adjacent end 16. The arms 18, 20 rotate between a hair-receiving, or open, position generally perpendicular to the body 12 and a hair-holding, or closed, position generally parallel to the body 12. When moving from the open position to the closed position, the arms 18, 20 rotate towards one another, thereby creating a hair-holding area between the arms and the inner surface of the body 12. The length of each of the arms 18, 20 is such that the ends 24, 26 of the arms overlap when the arms are in the closed position. The hair clamp 10 further comprises a biasing means 28, which biases, but does not lock, the arms 18, 20 in the closed position. Consequently, any desired amount of hair can be held in the hair-holding area between the arms and the interior surface of the body 12. Finally, the inner surfaces of the arms 18, 20 may be provided with a scalloped profile to prevent bunching of the gathered strands of hair in the hair-holding area.

Figure 3:
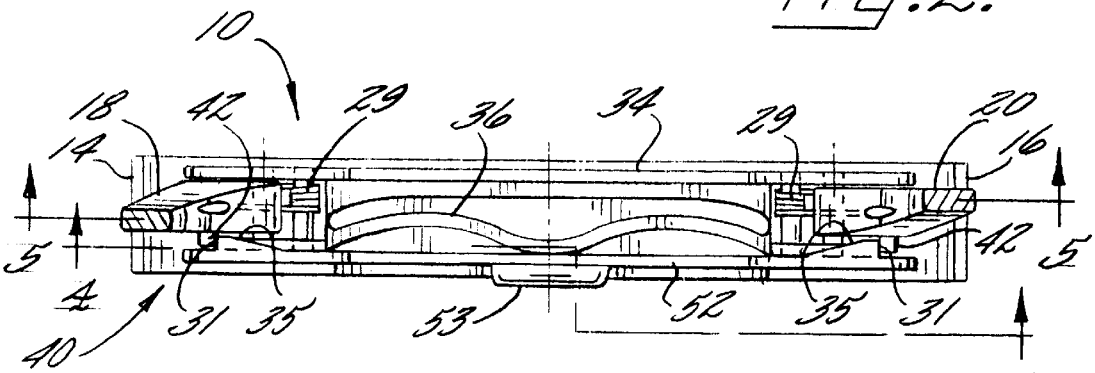
FIG. 3 is a sectional view of a preferred embodiment of a hair clamp according to the invention taken along line 3—3 of FIG. 1.
Figure 4:
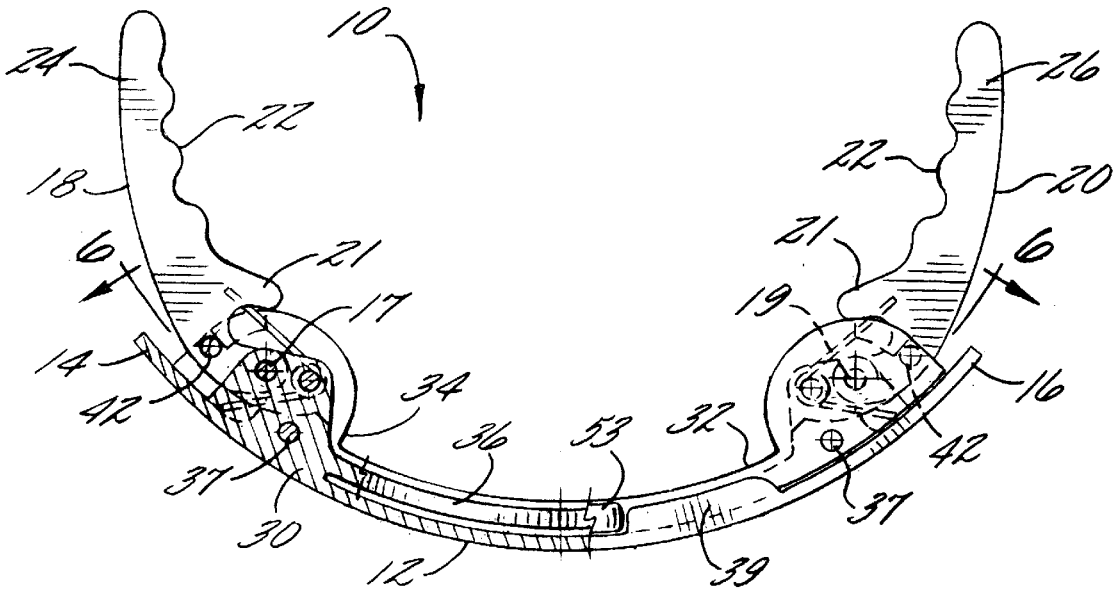
FIG. 4 is a partial sectional view and partial side view taken along line 4—4 of FIG. 3.
Figure 5:
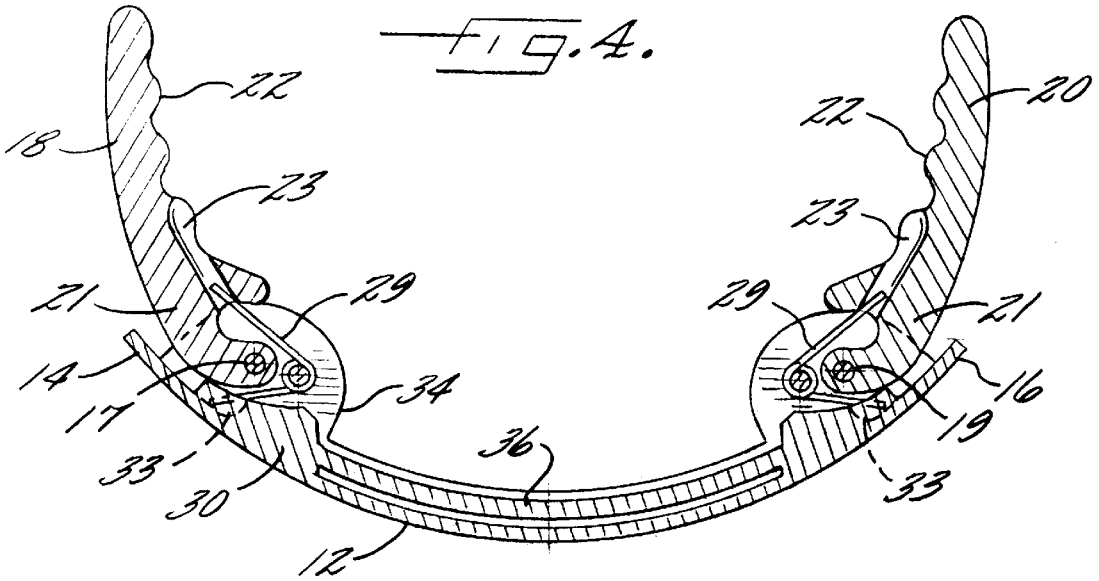
FIG. 5 is a sectional view taken along line 5—5 of FIG. 3.
Figure 6:
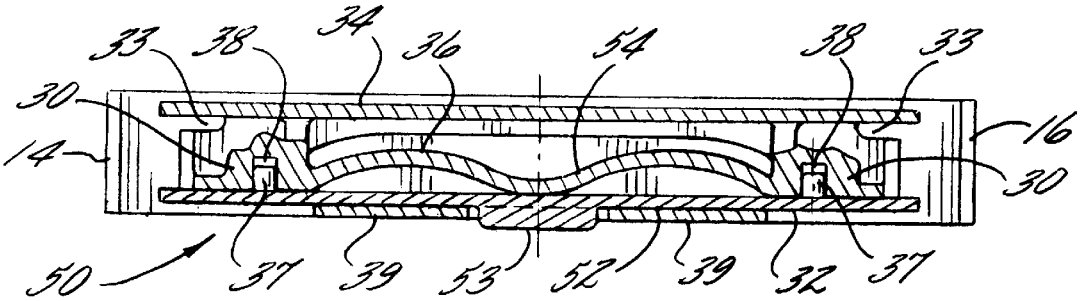
FIG. 6 is an arcuate sectional view taken along line 6—6 of FIG. 4.

In a preferred embodiment of the hair clamp 10 shown in FIGS. 2–8, the body 12 comprises a base 30 (FIG. 4) having a pair of opposed sides 32, 34 (FIG. 3; FIG. 6) depending generally perpendicularly from the inner surface of the base 30. Preferably, one of the sides 34 is fixed to the base 30 while the opposite side 32 is movable relative to the base, as will be described. In the preferred embodiment shown, each of the articulated arms 18, 20 comprises a proximate portion 21 (FIG. 4; FIG. 5) adjacent the base 30 and a scalloped portion 22 (FIG. 4; FIG. 5) extending outwardly from the proximate portion. The biasing means 28 comprises a torsion spring 29 (FIG. 5) positioned between the proximate portion 21 of each of the arms 18, 20 and the base 30. A pocket 23 (FIG. 5) is formed in each of the arms 18, 20 to receive one leg of the torsion spring 29. Likewise, a recess 33 (FIG. 5) is formed adjacent each end 14, 16 of the base 30 for receiving the other leg of the torsion spring 29.

The hair clamp 10 further comprises retaining means 40 (FIG. 3) for retaining the articulated arms 18, 20 in the open position. In the preferred embodiments shown herein, retaining means 40 comprises a pair of stop pins 42 (FIG. 3) extending outwardly from the proximate portions 21 of the arms 18, 20 and a corresponding pair of mechanical stops 31 (FIG. 2) provided on the inner surface of side 32. Side 32 is also provided with a pair of cam surfaces 35 (FIG. 2) upon which the stop pins 42 of the arms 18, 20 ride as the arms rotate between the open and closed positions.

The hair clamp 10 further comprises a releasing means 50 (FIG. 6) for releasing the articulated arms 18, 20 from the retaining means 40, thereby permitting the arms to rotate from the open position to the closed position under the influence of the biasing force of the biasing means 28. Generally, releasing means 50 comprises a control lever 52 and a yielding means 54 for permitting the control lever to move relative to the base 30 and the articulated arms 18, 20. In the preferred embodiment shown in FIGS. 2–8, the control lever 52 is side 32 and the yielding means 54 comprises a leaf spring 36 (FIG. 3, FIG. 6) molded on the inner surface of base 30.

As previously mentioned, side 32 (i.e., control lever 52) is movable relative to base 30. In the preferred embodiments shown herein, side 32 is provided with a pair of guide pins 37 (FIG. 2, FIG. 6) that engage pockets 38 (FIG. 6) formed in base 30. The pockets 38 receive the guide pins 37 therein to prevent side 32 from moving in a direction generally perpendicular to the base 30. The base 30 is also provided with a pair of spaced apart projections 39 (FIG. 4) depending generally perpendicularly from the inner surface of the base adjacent the outer surface of side 32. The projections 39 prevent side 32 from moving in a direction generally parallel to the base 30. Thus, side 32 is movable, yet retained on the hair clamp 10.

Figure 7:
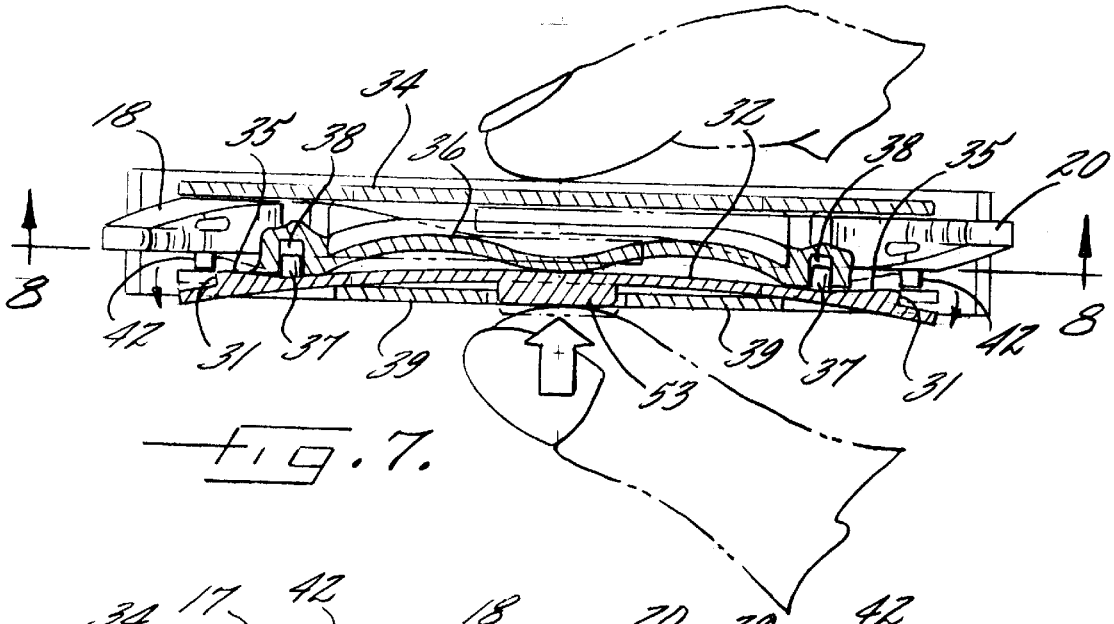
FIG. 7 is a top view of a preferred embodiment of a hair clamp according to the invention illustrating the operation of the control lever for causing rotation of the articulated arms from the open position to the hair-holding, or closed, position.
Figure 8:
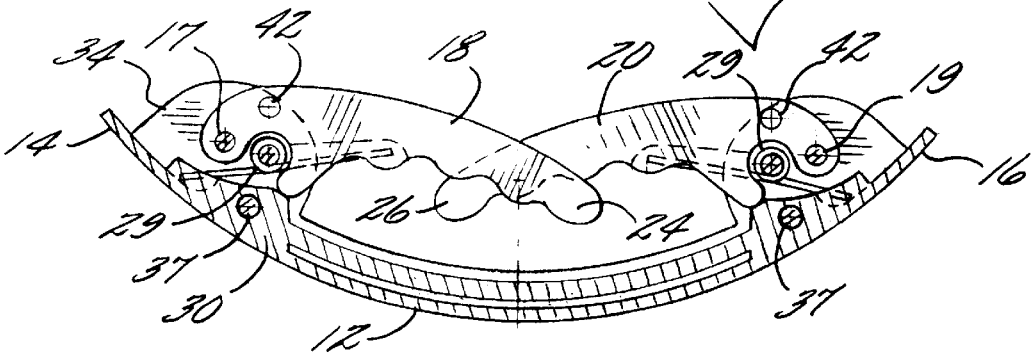
FIG. 8 is a sectional view taken along line 8—8 of FIG. 7 illustrating the hair clamp in the closed position.

As best shown in FIG. 7, leaf spring 36 (i.e., yielding means 54) is compressed when a force indicated by the large arrow is applied to the center of side 32 in a direction generally parallel to base 30. Preferably, side 32 is provided with a release button 53 (FIG. 2; FIG. 3; FIG. 6) to indicate to the wearer where to activate the releasing means 50. Depressing release button 53 as illustrated in FIG. 7 while holding the hair clamp 10 as illustrated in FIG. 1 causes the center of side 32 to deflect inwardly and the ends of side 32 to deflect outwardly as the medial portion of the side 32 is held between the base 30 on the inner surface and the projections 39 on the outer surface. As a result, mechanical stops 31 disengage from stop pins 42, thereby permitting the stop pins to ride upon the cam surfaces 35 under the influence of the biasing force of the torsion spring 29 so that the articulated arms 18, 20 rotate to the closed position as previously described.

Figure 9:
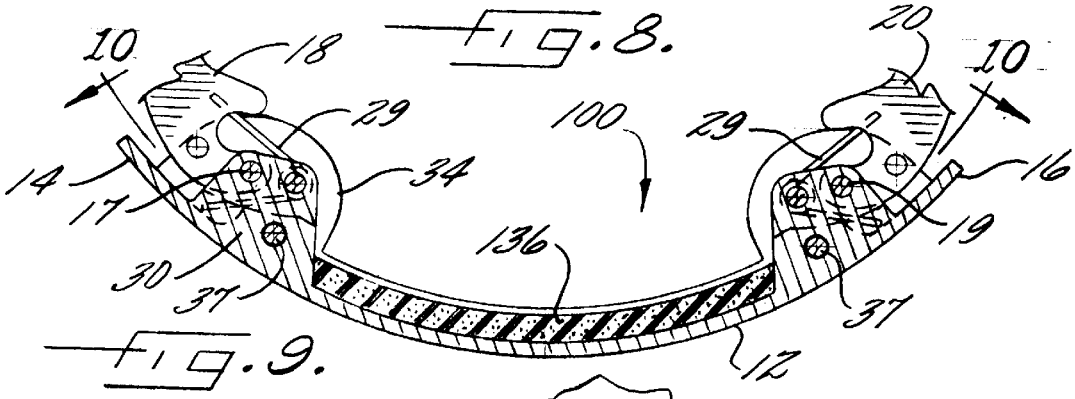
FIG. 9 is a sectional view of an alternative embodiment of a hair clamp according to the invention.
Figure 10:
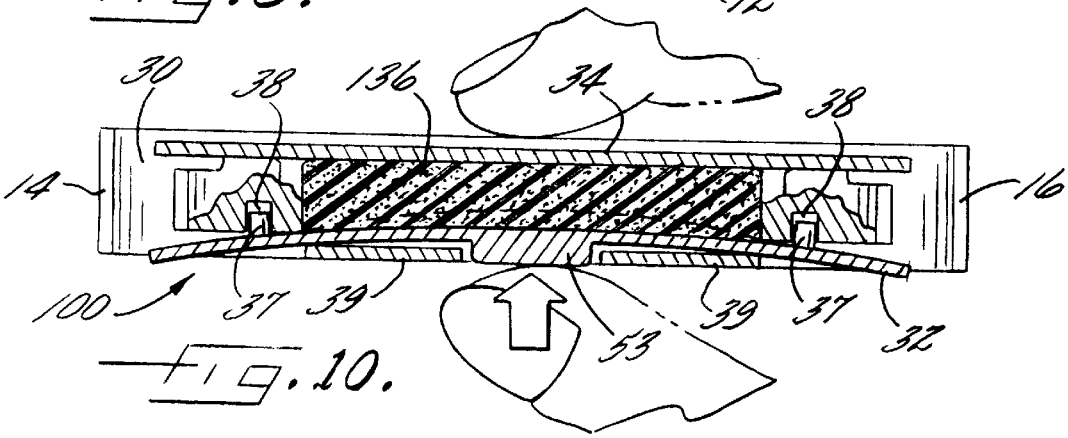
FIG. 10 is an arcuate sectional view taken along line 10—10 of FIG. 9.

An alternative embodiment of a hair clamp 100 according to the invention is shown in FIGS. 9 and 10. The structural components of the hair clamp 100 are identical to the structural components of the hair clamp 10 previously described with one notable exception. The leaf spring 36 of the yielding means 54 of the releasing means 50 is replaced by a resilient insert 136. Preferably, the insert 136 is made of a soft rubber or foam material, such as neoprene or foam polyvinylchloride (PVC), having sufficient memory to return the insert to its original, non-deformed state after the release button 53 is depressed and released. Preferably, the insert 136 is positioned within and extends over the entire length of the medial portion of the base 30. As a result, the gathered strands of hair are distributed uniformly over the entire usable length of the hair clamp 100.

Figure 11:
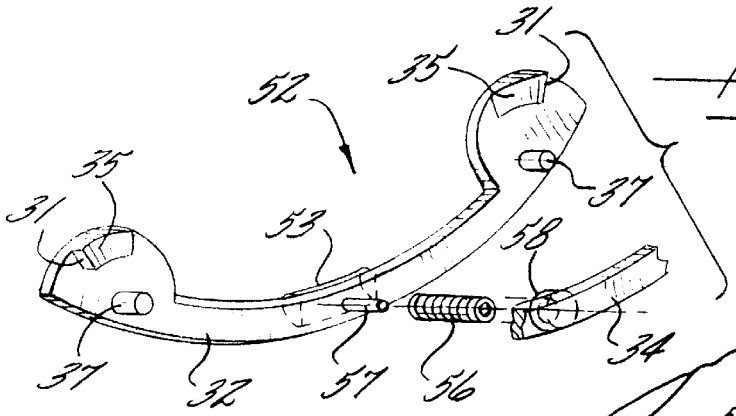
FIG. 11 is a perspective view of the control lever of another alternative embodiment of a hair clamp according to the invention.
Figure 12:
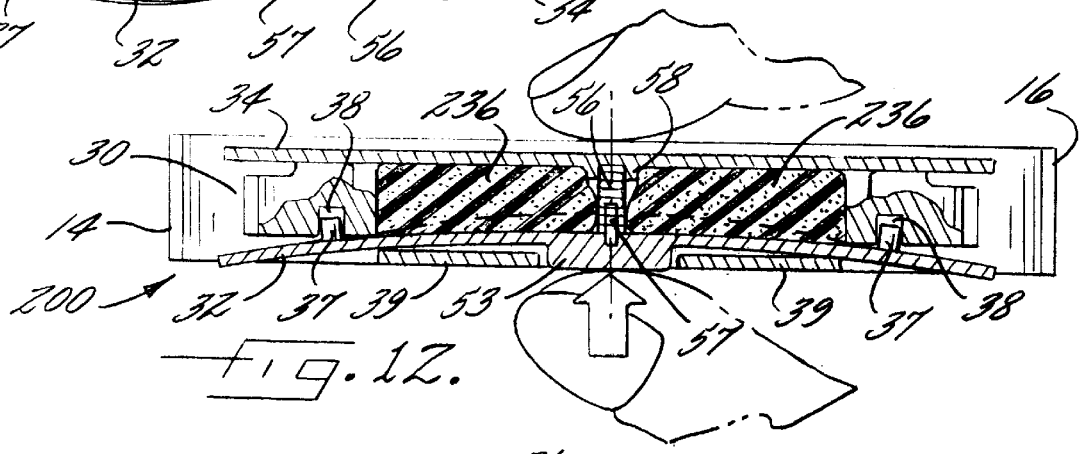
FIG. 12 is an arcuate sectional view of another alternative embodiment of a hair clamp according to the invention.

Another alternative embodiment of a hair clamp 200 according to the invention is shown in FIGS. 11 and 12. The structural components of the hair clamp 200 are identical to the structural components of the hair clamp 100 previously described with the following notable exceptions. The control lever 52 further comprises a coil spring 56, a spring retaining post 57 and a spring retaining recess 58. The spring retaining post 57 depends generally perpendicularly from the inner surface of the side 32 opposite the release button 53 and the spring retaining recess 58 is formed in the inner surface of the side 34. The coil spring 56 is positioned between the side 32 and the side 34 with one end of the coil spring positioned over the spring retaining post 56 and the other end of the coil spring positioned within the spring retaining recess 58. Accordingly, the coil spring 56 is compressed when the release button 53 is depressed and returns to its original, non-deformed state once the release button 53 is released. Preferably, the resilient inserts 236 comprise a pair of the resilient inserts 136 positioned within and extending over substantially the entire length of the medial portion of the base 30. As a result, the gathered strands of hair are distributed uniformly over the entire usable length of the hair clamp 200.

Figure 13:
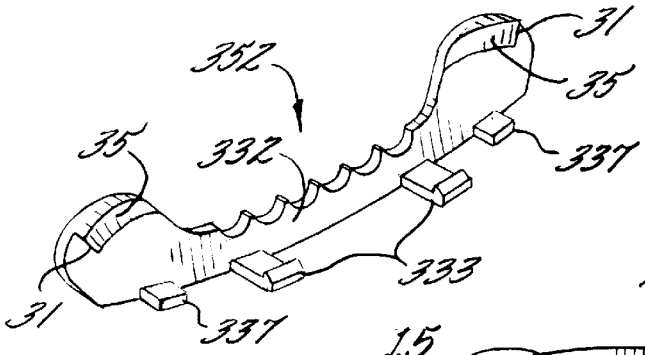
FIG. 13 is a perspective view of the control lever of yet another alternative embodiment of a hair clamp according to the invention.
Figure 14:
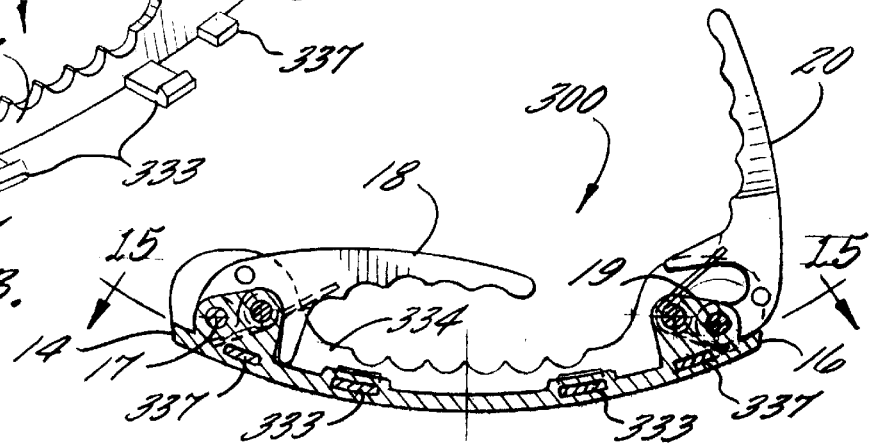
FIG. 14 is a sectional view of the alternative embodiment of the hair clamp of FIG. 13 illustrating one of the articulated arms in the open position and one of the articulated arms in the closed position.
Figure 15:
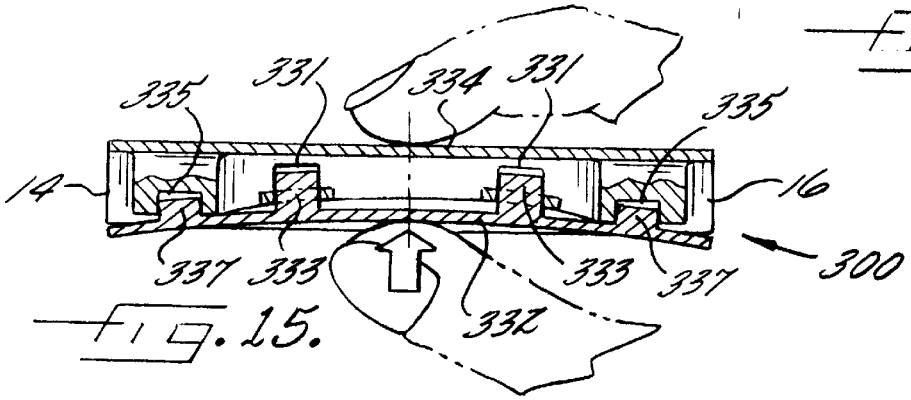
FIG. 15 is an arcuate sectional view taken along line 15—15 of FIG. 14.

Yet another alternative embodiment of a hair clamp 300 according to the invention is shown in FIGS. 13–15. The hair clamp 300 comprises an elongate, slightly arcuate base 330 and a pair of articulated arms 318, 320 rotatably attached to the base. Sides 332, 334 depend generally perpendicularly from the inner surface of the base 330. Side 334 is fixed to the inner surface of base 330. Side 332, however, is movably attached to the base 330, as will be described. Preferably, side 332 comprises a pair of inner guide tabs 333 and a pair of outer guide tabs 337. The inner guide tabs 333 are received in pockets 331 formed in the base 330 such that the side 332 is removably secured to the base 330, for example by engagement of resilient, molded plastic parts. Pockets 331 are sized to retain side 332 while permitting the inner guide tabs to move linearly within the pockets 331 when the side 332 is depressed in the direction indicated by the large arrow in FIG. 15. The outer guide tabs 337 are received in slightly oversized pockets 335 formed in the base 330. The pockets 335 are sized to retain side 332 while permitting the outer guide tabs 337 to move linearly and to rotate slightly within the pockets 335 when the side 332 is depressed.

The hair clamp 300 functions in the same manner as the hair clamps 10, 100 and 200 previously described with the exception that the yielding means 54 is replaced by a curved recess 354 formed in the base 330 and control lever 52 is replaced by control lever 352, which is side 332. Accordingly, depressing the outer surface of side 332 between the inner guide tabs 333 while holding the hair clamp 300 as illustrated in FIG. 15 causes the center of side 332 to deflect inwardly and the ends of side 332 to deflect outwardly as the medial portion of the side 332 pivots about the ends of the curved recess 354. As a result, mechanical stops 31 disengage from stop pins 42, thereby permitting the stop pins to ride upon the cam surfaces 35 under the influence of the biasing force of the torsion spring 29 so that the articulated arms 18, 20 rotate to the closed position as previously described. In addition, the medial portions of sides 332, 334 may be scalloped in the same manner as the inner surfaces of articulated arms 18, 20 so that the gathered strands of hair are distributed uniformly across the entire useable length of the hair clamp 300, as previously described.

Figure 16:
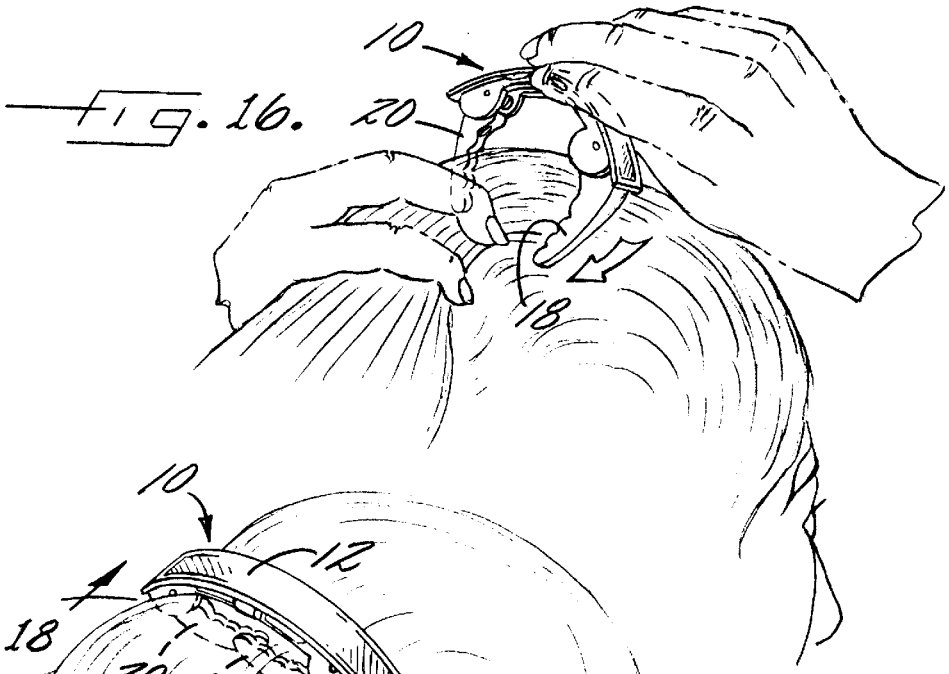
FIG. 16 is a perspective view of a hair clamp according to the invention illustrating the articulated arms in the open position and the hair clamp being inserted around gathered strands of hair.
Figure 17:
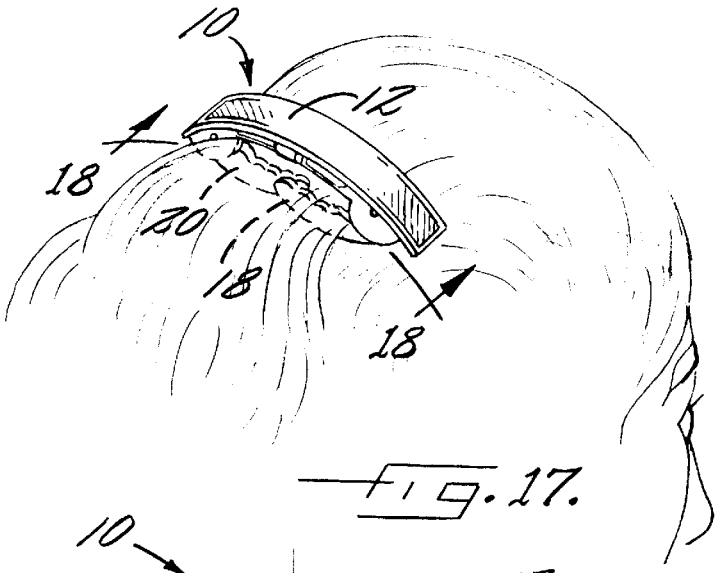
FIG. 17 is a perspective view of a hair clamp according to the invention illustrating the articulated arms in the closed position and the hair clamp holding gathered strands of hair.
Figure 18:
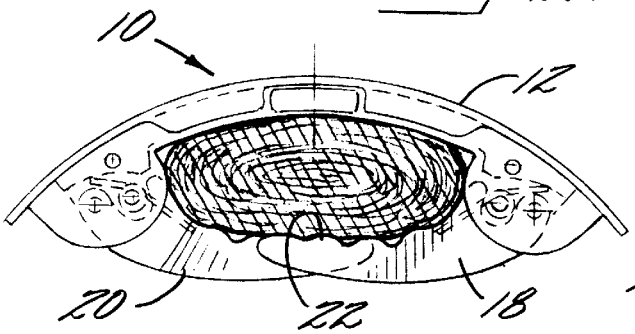
FIG. 18 is an arcuate sectional view taken along line 18—18 of FIG. 17 illustrating gathered strands of hair held within the hair clamp.

FIGS. 16–18 illustrate a preferred method of inserting a hair clamp according to the invention around gathered strands of hair. The desired amount of gathered strands of hair is grasped in one hand, for example in the shape of a ponytail. The articulated arms 18, 20 are then rotated to the open position against the biasing force of the torsion springs 29 until the stop pins 42 engage the mechanical stops 31 provided on the inner surface of the side 32, thereby retaining the arms in the open position. The hair clamp is then grasped in the other hand with one finger placed over the release button 53. The articulated arms 18, 20 of the hair clamp are then positioned around the gathered strands of hair from above, rather from the side, so that the desired amount of hair is held within the hair clamp. Once the desired amount of hair is positioned between the articulated arms 18, 20, the release button 53 is depressed to cause the articulated arms to rotate in the manner previously described to the closed position illustrated in FIG. 17. As best shown in FIG. 18, inserting the hair clamp from above, rather than from the side, results in the gathered strands of hair being distributed uniformly over the entire useable length within the hair-holding region of the hair clamp. It is believed that the resilient inserts 136, 236 and the scalloped medial portions of the articulated arms 18, 20 previously described further contribute to the uniform distribution of the hair, as well as providing resistance against the hair clamp slipping or falling out of gathered strands of thinner hair. With the gathered strands of uniformly distributed over the entire useable length of the hair clamp, the tendency for the gathered strands of hair to bunch together or for the hair clamp to pull on the wearer's hair or scalp is significantly reduced, if not eliminated.

Figure 19:
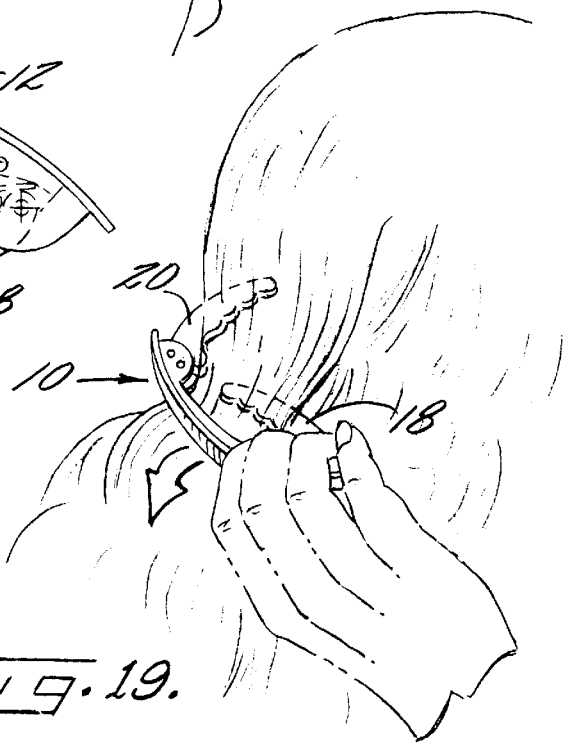
FIG. 19 is a perspective view of a hair clamp according to the invention illustrating the hair clamp being removed from around gathered strands of hair.

FIG. 19 illustrates a preferred method of removing a hair clamp according to the invention from around gathered strands of hair. As previously mentioned, the articulated arms 18, 20 are biased, but are not locked in the closed position. Accordingly, the hair clamp of the present invention may be easily and readily removed without the need to unclasp or unlock a hinged inner member from an outer member. In contrast, the hair clamp of the present invention may be removed by simply rotating the hair clamp downward relative to the gathered strands of hair and moving the hair clamp outward or sideward away from the hair. The downward rotation of the hair clamp results in at least one of the articulated arms 18, 20 opening against the biasing force of the torsion spring 29 such that the stop pin 42 begins to ride upon the cam surface 35 in the direction of the mechanical stop 31. Once the arm has overcome the initial resistance of the biasing force of the torsion spring, less effort is required to remove the hair clamp from around the gathered strands of hair. As a result, the tendency for the hair clamp to pull on the wearer's hair or scalp is significantly reduced, if not eliminated.

From the foregoing, it is readily apparent that the present invention provides an improved hair clamp for holding braided or otherwise gathered strands of hair in a uniform and comfortable manner. In the broadest sense, the hair clamp comprises an elongate base and a pair of articulated arms that are rotatably attached to the base such that the arms rotate between a hair-receiving, or open, position and a hair-holding, or closed, position. Because the articulated arms may be retained in the open position, the hair clamp may be inserted around the gathered strands of hair from above rather than from the side. Because the articulated arms are not locked in the closed position, any desired amount of gathered strands of hair can be retained without pulling on the wearer's hair or scalp. The biased, articulated arms also enable the improved hair clamp to be easily removed without pulling on the wearer's hair or scalp.

It is to be understood that the foregoing description and specific embodiments described and shown herein are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A hair clamp for holding braided or otherwise gathered strands of hair comprising:

an elongate body having opposed ends;

a pair of opposed arms, each of said arms pivotally attached to said body proximate to one of said opposed ends and rotatable between an open hair-receiving position generally perpendicular to said body and a closed hair-holding position generally parallel to said body;

biasing means for biasing said arms in the closed position;

retaining means for retaining said arms in the open position against the biasing force of said biasing means; and releasing means for releasing said arms from said retaining means so that said biasing means rotates said arms from the open position to the closed position.

2. The hair clamp of claim 1 wherein said body comprises a generally rectangular, arcuate base defining an inner surface and an outer surface; and a pair of sides depending generally perpendicularly from the inner surface of said base, one of said sides fixed to the inner surface of said base and the other of said sides movable relative to said base and defining an inner surface.

3. The hair clamp of claim 2 wherein said retaining means comprises a pair of stop pins, each of said stop pins depending generally perpendicularly from one of said arms, and a complementary pair of mechanical stops, each of said mechanical stops provided on the inner surface of said movable side.

4. The hair clamp of claim 2 wherein said releasing means comprises a control lever and yielding means for permitting said control lever to move relative to said base and said arms in a direction generally parallel to said base.

5. The hair clamp of claim 4 wherein said yielding means comprises a leaf spring positioned adjacent the inner surface of said base between said pair of opposed sides.

6. The hair clamp of claim 5 wherein said base is made of a plastic material and said leaf spring is molded into said base.

7. The hair clamp of claim 4 wherein said yielding means comprises an insert made of a resilient material positioned adjacent the inner surface of said base between said pair of opposed sides.

8. The hair clamp of claim 4 wherein said yielding means comprises a pair of inserts made of a resilient material positioned adjacent the inner surface of said base between said pair of opposed sides and a coil spring positioned between said pair of inserts and between said pair of opposed sides.

9. The hair clamp of claim 8 wherein said yielding means further comprises a spring retaining pin depending generally perpendicularly from said fixed side and a spring retaining recess formed in said movable side opposite said spring retaining pin.

10. The hair clamp of claim 4 wherein said yielding means comprises said movable side and wherein said movable side comprises a pair of inner guide tabs for engaging a corresponding pair of inner pockets formed in said base and a pair of outer guide tabs for engaging a corresponding pair of outer pockets formed in said base.

11. The hair clamp of claim 1 wherein said biasing means comprises a pair of torsion springs, each of said torsion springs positioned between one of said opposed arms and said body.

12. The hair clamp of claim 1 wherein the inner surface of each of said arms has a scalloped profile for preventing bunching of the gathered strands of hair.

13. A hair clamp for retaining braided or otherwise gathered strands of hair comprising:

an elongate, generally rectangular base having opposed ends and defining an inner surface;

a pair of opposed sides depending generally perpendicularly from the inner surface of said base, one of said sides fixed to the inner surface of said base and the other of said sides movable relative to said base and defining an inner surface;

a pair of opposed arms, each of said arms pivotally attached to said base proximate to one of said opposed ends and rotatable between an open hair-receiving position generally perpendicular to said base and a closed hair-holding position generally parallel to said base;

a pair of torsion springs, each of said torsion springs positioned between one of said arms and said base and creating a biasing force therebetween;

a pair of stop pins, each of said stop pins depending generally perpendicularly from one of said arms;

a pair of mechanical stops for engaging said stop pins to retain said arms in the open position against the biasing force of said torsion springs, each of said mechanical stops provided on the inner surface of said movable side adjacent one of said opposed ends of said base; and a control lever for releasing said mechanical stops from engaging said stop pins so that the biasing force of said torsion springs rotates said arms from the open position to the closed position.

* * * * *